US007326112B2

(12) United States Patent
Nordman

(10) Patent No.: US 7,326,112 B2
(45) **Date of Patent: *Feb. 5, 2008**

(54) GAMING DEVICE HAVING DISPLAY WITH INTERACTING MULTIPLE ROTATING MEMBERS AND INDICATOR

(75) Inventor: Dennis Nordman, Lake Villa, IL (US)

(73) Assignee: IGT, Reno, NV (US)

( * ) Notice: Subject to any disclaimer, the term of this patent is extended or adjusted under 35 U.S.C. 154(b) by 318 days.

This patent is subject to a terminal disclaimer.

(21) Appl. No.: 11/152,384

(22) Filed: Jun. 13, 2005

(65) Prior Publication Data

US 2005/0227755 A1 Oct. 13, 2005

Related U.S. Application Data

(63) Continuation of application No. 10/640,840, filed on Aug. 14, 2003, now Pat. No. 6,905,407.

(51) Int. Cl.
*G07F 17/34* (2006.01)

(52) U.S. Cl. ..... 463/20; 463/22; 273/143 R; 273/141 A; 273/142 H; 273/142 R; 273/138.2

(58) Field of Classification Search ..... 273/143 R, 273/144 B, 142 H, 142 HA, 138.2, 138.1, 273/141 A, 142 R; 463/20, 17, 16, 13, 22
See application file for complete search history.

(56) References Cited

U.S. PATENT DOCUMENTS 636,508 A * 11/1899 Eickershoff ..... 273/141 R
2,545,644 A 3/1951 Benton et al.
3,975,022 A 8/1976 Figueroa
4,410,178 A 10/1983 Partridge
4,695,053 A 9/1987 Vazquez, Jr. et al.
4,732,386 A 3/1988 Rayfiel
4,941,665 A * 7/1990 Klamer ..... 273/142 H
5,152,529 A 10/1992 Okada
5,184,821 A * 2/1993 Korenek ..... 273/138.2
5,364,100 A 11/1994 Ludlow et al.

(Continued)

OTHER PUBLICATIONS

4DU Dice Unit Advertisement written by starpoint.uk.com, printed on Sep. 3, 2002.

(Continued)

*Primary Examiner*—Benjamin Layno
(74) *Attorney, Agent, or Firm*—Bell, Boyd & Lloyd LLP

(57) ABSTRACT

A gaming device which includes a display having multiple rotating members and at least one rotating indicator. The members each include at least one symbol. The symbols represent various types of awards that the player can win. The members move or spin. At the same time or at a different time, the one or more indicator moves or spins. At varying times, each of the symbols of the members will be closer to the indicator than the other symbols, i.e., in an indicating position. At varying times, the moving indicator indicates, or points, to each of the members and thus one of the symbols of the members. Ultimately, the members and the indicators stop moving, and the indicator indicates one of the symbols from one of the members. An outcome such as an award is provided to the player that is based on the indicated symbol.

23 Claims, 10 Drawing Sheets

U.S. PATENT DOCUMENTS

| | | | | |
|---|---|---|---|---|
| 5,395,111 | A | 3/1995 | Inoue | |
| 5,449,173 | A | 9/1995 | Thomas et al. | |
| 5,560,603 | A | 10/1996 | Seelig et al. | |
| 5,584,763 | A | 12/1996 | Kelly et al. | |
| 5,664,998 | A | 9/1997 | Seelig et al. | |
| 5,823,872 | A | 10/1998 | Prather et al. | |
| 5,823,874 | A | 10/1998 | Adams et al. | |
| D400,597 | S | 11/1998 | Hedrick et al. | |
| D402,702 | S | 12/1998 | Seelig et al. | |
| 5,848,932 | A | 12/1998 | Adams | |
| D406,865 | S | 3/1999 | Heidel | |
| 5,882,261 | A | 3/1999 | Adams | |
| 5,911,418 | A | 6/1999 | Adams | |
| 5,927,714 | A | 7/1999 | Kaplan | |
| 5,976,015 | A | 11/1999 | Seelig et al. | |
| 6,004,207 | A | 12/1999 | Wilson, Jr. et al. | |
| 6,059,658 | A | 5/2000 | Mangano et al. | |
| 6,086,066 | A | 7/2000 | Takeuchi et al. | |
| 6,089,977 | A | 7/2000 | Bennett | |
| 6,089,978 | A | 7/2000 | Adams | |
| 6,105,962 | A | 8/2000 | Malavazos et al. | |
| 6,113,098 | A | 9/2000 | Adams | |
| 6,142,873 | A | 11/2000 | Weiss et al. | |
| 6,142,874 | A | 11/2000 | Kodachi et al. | |
| 6,159,098 | A | 12/2000 | Slomiany et al. | |
| 6,162,121 | A | 12/2000 | Morro et al. | |
| 6,173,955 | B1 | 1/2001 | Perrie et al. | |
| 6,203,429 | B1 | 3/2001 | Demar et al. | |
| D441,031 | S | 4/2001 | Seelig et al. | |
| 6,213,876 | B1 | 4/2001 | Moore, Jr. | |
| 6,220,593 | B1 | 4/2001 | Pierce et al. | |
| 6,224,483 | B1 | 5/2001 | Mayeroff | |
| 6,227,970 | B1 | 5/2001 | Shimizu et al. | |
| D443,313 | S | 6/2001 | Brettschneider | |
| 6,251,013 | B1 | 6/2001 | Bennett | |
| 6,254,481 | B1 | 7/2001 | Jaffe | |
| 6,267,669 | B1 | 7/2001 | Luciano, Jr. et al. | |
| 6,270,411 | B1 | 8/2001 | Gura et al. | |
| 6,302,790 | B1 | 10/2001 | Brossard | |
| 6,305,686 | B1 | 10/2001 | Perrie et al. | |
| 6,315,663 | B1 | 11/2001 | Sakamoto | |
| 6,336,863 | B1 | 1/2002 | Baerlocher et al. | |
| 6,340,158 | B2 | 1/2002 | Pierce et al. | |
| 6,368,216 | B1 | 4/2002 | Hedrick et al. | |
| 6,386,974 | B1 | 5/2002 | Adams | |
| 6,398,220 | B1 | 6/2002 | Inoue | |
| 6,419,579 | B1 | 7/2002 | Bennett | |
| 6,461,241 | B1 | 10/2002 | Webb et al. | |
| D465,531 | S | 11/2002 | Luciano, Jr. et al. | |
| 6,481,713 | B2 | 11/2002 | Perrie et al. | |
| 6,533,660 | B2 | 3/2003 | Seelig et al. | |
| 6,537,152 | B2 | 3/2003 | Seelig et al. | |
| 6,582,307 | B2 | 6/2003 | Webb | |
| 6,609,972 | B2 | 8/2003 | Seelig et al. | |
| 6,712,694 | B1 | 3/2004 | Nordman | |
| 6,855,056 | B2 * | 2/2005 | Inoue | 463/31 |
| 2003/0040358 | A1 | 2/2003 | Rothkranz et al. | |
| 2004/0053658 | A1 | 3/2004 | Rothranz | |
| 2004/0053659 | A1 | 3/2004 | Rothkranz et al. | |
| 2004/0053670 | A1 | 3/2004 | Rothkranz et al. | |
| 2004/0053687 | A1 | 3/2004 | Nordman et al. | |
| 2004/0121840 | A1 | 6/2004 | Rosander et al. | |

OTHER PUBLICATIONS

American Bandstand Brochure written by Anchor Games, published in 2001.

Big Shot!™ Advertisement published by Aristocrat Technologies, Inc., published in 2002.

Big Top Keno Advertisement published by Aristocrat Technologies, Inc., published in 2000.

Bonus Roulette Brochure written by F. Franco, not dated.

Buck's Roulette Brochure written by R. Franco, not dated.

Chariot's of Fortune Brochure written by R. Franco, not dated.

Classic Pot of Gold Brochure written by Ace Coin Equipment Ltd., not dated.

Cyberdyne Gaming Brochure written by Cyberdyne Gaming, not dated.

Elvira® Mistress of the Dark™ Advertisement written by IGT, published in 2002.

Elvis Hits Advertisement written by IGT, published in 1999.

Holy Smoke Brochure written by Impulse Gaming Ltd., not dated.

Jack and the Beanstalk™ Brochure written by AC Coin & Slot, not dated.

King of the Grill™ Brochure written by AC Coin & Slot, not dated.

Lemons, Cherries and Bell-Fruit-Gum written by Richard M. Bueschel, pp. 39-41, 64, 70, 137, 149-150, 195-196 and 251, 1995.

Line-Up Brochure written by AC Coin & Slot, not dated.

Little Green Men Jr.™ Advertisement written by AC Coin & Slot, not dated.

Little Green Men Jr.™ Article written by Strictly Slots, published in Feb. 2003.

Miss America Brochure written by AC Coin & Slot, not dated.

Mix and Match Article written by Strictly Slots, published in Apr. 2002.

Mix and Match Advertisement published by AC Coin & Slot, not dated.

Money Grab Article written by Strictly Slots, published in Apr. 2001.

Monster Match Article written by Strictly Slots, published in Jan. 2002.

On The Money! Article written by Strictly Slots, published in Dec. 2000.

Payout!™ Advertisement written by www.csds.com/Gaming/Products/g_Payout.htm, printaed on Jan. 15, 2001.

Payout!™ Article written by Casino Data Systems, not dated.

Pick a Prize Brochure written by Acres Gaming Incorporated, published prior 2001.

Power Slotto Brochure published by AC Coin & Slot prior to 2002.

Press Your Luck Brochure published by AC Coin & Slot prior to 2002.

Quick Pick Paytime Brochure written by Acres Gaming Incorporated, published prior to 2001.

R&B™ Brochure published by AC Coin & Slot, not dated.

Reel Dice Advertisement written by Gerber & Glass, published in 1936.

Royal Roulette Brochure written by Impulse Gaming Ltd., not dated.

Slot Machine Buyer's Handbook, A Consumer's Guide to Slot Machines written by David L. Saul and Daniel R. Mead, published in 1998.

Silver City Roundup Brochure published by AC Coin & Slot, not dated.

Slot Machines A Pictorial History of the First 100 Years, 5th edition written by Marshall Fey, published in 1983-1997.

Slot Machines and Coin-Op Games written by Bill Kurtz, pp. 16, 65, 105 and 111, 1991.

Slot Machines on Parade, 1st edition written by Robert N. Geddes and illustrated by Daniel R. Mead, published in 1980.

Spin-A-Lot Brochure written by Acres Gaming Incorporated, published prior to 2001.

Take Your Pick Article written by Strictly Slots, published in Mar. 2001.

Yahtzee Bonus Adertisement written by Mikohn, published in 1999.

* cited by examiner

GAMING DEVICE HAVING DISPLAY WITH INTERACTING MULTIPLE ROTATING MEMBERS AND INDICATOR

PRIORITY CLAIM

This application is a continuation of, claims priority to and the benefit of U.S. patent application Ser. No. 10/640,840 filed Aug. 14, 2003, now issued U.S. Pat. No. 6,905,407, the entire contents of which are incorporated herein.

SUMMARY OF THE INVENTION

The present invention relates to gaming devices. More particularly, the present invention relates to wagering gaming device displays.

Gaming devices, such as slot machines and video poker machines, provide fun and excitement to the player. Gaming, in general, provides an escape from the everyday rigors of life. Gaming devices and gaming establishments use bright lights and exciting sounds to set the gaming world apart from the rest of the world. Gaming devices, in particular, use one or more displays that enable the player to see and play the game. The displays typically portray the action of the game and ultimately indicate whether or not the player wins.

Slot machine and other gaming device displays have gone through a number of transitions since their inception. Originally, slot machines displayed purely mechanical reels. While these machines gained enormous popularity, the mechanical nature of the reels limited the number of paystops, which limited the number of different symbols and the number of different winning symbol combinations.

The advent of the computer and the video monitor expanded the possibilities for gaming devices. There are now video poker, video blackjack and other types of video gaming machines. Video displays have also been implemented in slot machines. The video slot machines use computers to randomly generate symbol combinations from an expanded number of different symbols. Video reel strips can include a virtually unlimited number of symbols, which enables a wide variety of different symbol combinations to be employed, including combinations that appear very infrequently and yield high payouts.

With slot machines, the video monitors have also been used to provide bonus or secondary games. Bonus games in gaming machines have become much more prevalent and elaborate in recent years. For example, players play the base game of slot until becoming eligible for a bonus game. The base game temporarily pauses, while the player plays the bonus game. When the player completes the bonus game, the gaming device returns the player to the bonus game.

It should therefore be appreciated that a single video monitor is often sufficient to provide both the base game of slot and one or more bonus games that become triggered by the slot game. As illustrated in FIG. 1B, there is room on the cabinet of gaming device 10*b* for an upper display area 32. This area, however, is often not utilized for gaming purposes and may simply provide a paytable, graphics and/or lettering that pertains to a theme of the gaming device.

Video monitors and in particular video-based slot machines are likely going to continue growing in popularity. As the video monitor has been used more and more, however, there has been a growing sentiment that some of the mystique of the old time mechanical gaming devices is lost when mechanical reels and mechanical displays are replaced by a video monitor.

Accordingly, a need exists to provide a gaming device that may use a video monitor, which provides increased flexibility to the gaming device to add more symbols and more elaborate bonus games, while providing some aspect of the gaming device that is mechanical and provides a fun and exciting mechanical display.

SUMMARY OF THE INVENTION

The present invention provides a display for a gaming device and in one embodiment a mechanical display for a slot machine. The display includes multiple rotating members and at least one rotating indicator. The members each include at least one symbol and preferably a plurality of symbols. The symbols represent various types of awards that the player can win, such as game credits, game credit multipliers, a number of free spins, a number of free games, a number of picks from a prize pool, an entry into a bonus game and/or any combination thereof. The members move or spin. At the same time or at a different time, one or more indicator moves or spins.

At varying times, each of the symbols of the members will be closer to the indicator than the other symbols (i.e., which in one embodiment is an indicating position). At varying times, the moving indicator indicates, or points to each of the members and thus one of the symbols of the members. Ultimately, the members and the indicators stop moving, and the indicator indicates one of the symbols from one of the members. An award is provided to the player that is based on the indicated symbol.

In one embodiment, the members are spinning wheels that are positioned around the indicator. The wheels each include pie shaped wedges, each wedge displaying a separate symbol. The display can have any suitable number of wheels positioned in any suitable arrangement about the indicator. The wheels can display any suitable number of wedges and symbols. In other embodiments, multiple indicators are provided and multiple members are placed around each of the indicators. Here, it is possible that the multiple indicators can indicate symbols from the same member.

The sequence of motion produced by the members and indicator(s) can be in various forms in accordance with the present invention. The members and indicator(s) can move at the same time (i.e., simultaneously), at overlapping times or at completely different times (such as sequentially). The members themselves can move at the same time (i.e., simultaneously), at overlapping times or at completely different times (such as sequentially). When multiple indicators are provided, the indicators themselves can move at the same time (i.e., simultaneously), at overlapping times or at completely different times (such as sequentially).

The display is computer controlled in various embodiments and mechanically or electromechanically controlled in other embodiments. In one embodiment, a main game processor communicates with one or more motion controllers, wherein each motion controller controls the motion of a motion producing device. It is also contemplated that one or more motion controllers are provided that communicate with the processor and that control multiple motion producing devices. The motion producing device includes devices that produce linear motion, such as linear actuators or solenoids and devices that produce rotary motion, such as stepper or servo motors. Other motion producing devices are contemplated by the present invention. The rotary motion in various embodiments is converted to linear motion, such as through a ball screw or gantry system.

In the computer controlled embodiments, the members and indicator(s) can be controlled independently. Here, the motion of each member and indicator is independent and separate. Different members and indicators can move at different times, speeds, accelerations, durations, directions and combinations thereof. The processor operates with a memory device that stores one or more programs for each motion producing device, making it possible for the members and indicators to operate and move differently in different display sequences. The programs are alternatively stored on the motion controllers.

The display ultimately produces the outcome of a random generation. That is, the processor at some point generates randomly an outcome for the player, which is provided, at least in part, to the player through the indication of one or more of the symbols on one or more of the members by one or more of the indicators. For example, the processor can randomly generate an award of one hundred credits for the player, wherein the award is provided by a first indicator indicating or pointing towards fifty credits and another indicator pointing towards or indicating a 2× multiplier.

In the computer controlled embodiments, the movement of the display carries out a sequence that culminates in the indication of a previously randomly determined award. The award can be randomly determined immediately before the award is indicated and even while the motion sequence is carried out. Alternatively, the award is randomly determined at any desirable time before the motion sequence begins.

In other embodiments, the motion is mechanically or electromechanically produced. Here, the motion of the members and indicator(s) is random, producing a random outcome on the spot. The gaming device provides one or more motion producing devices, such as linear or rotational motion producing devices that set the members and indicators in motion, wherein gravity and/or friction cause the movement of the members and indicator(s) to stop. In these embodiments, one or more sensors are provided to detect the position of the members and indicator(s) after the stoppage of movement, wherein the sensors communicate the indicated symbol or award (which may be a combination of different symbols) to the processor, and wherein the processor commands the appropriate response to take place, e.g., the issuing of credits on a credit meter.

Additional features and advantages of the present invention are described in, and will be apparent from, the following Detailed Description of the Invention and the figures.

DETAILED DESCRIPTION OF THE INVENTION

The present invention provides a display and display indicators that operate with a multitude of primary or base wagering games, including but not limited to the games of slot, poker, keno, blackjack, bunco and checkers. In an embodiment, the display and indicators operate in conjunction with secondary or bonus games, which in turn operate in conjunction with the above listed primary games. Besides such base and bonus games, the present invention can operate with any of the bonus triggering events, as well as any progressive game coordinating with these base games. The symbols and indicia used for any of the primary or base games, bonus or secondary games or progressive games include any suitable symbols, images or indicia.

Figure 1A:
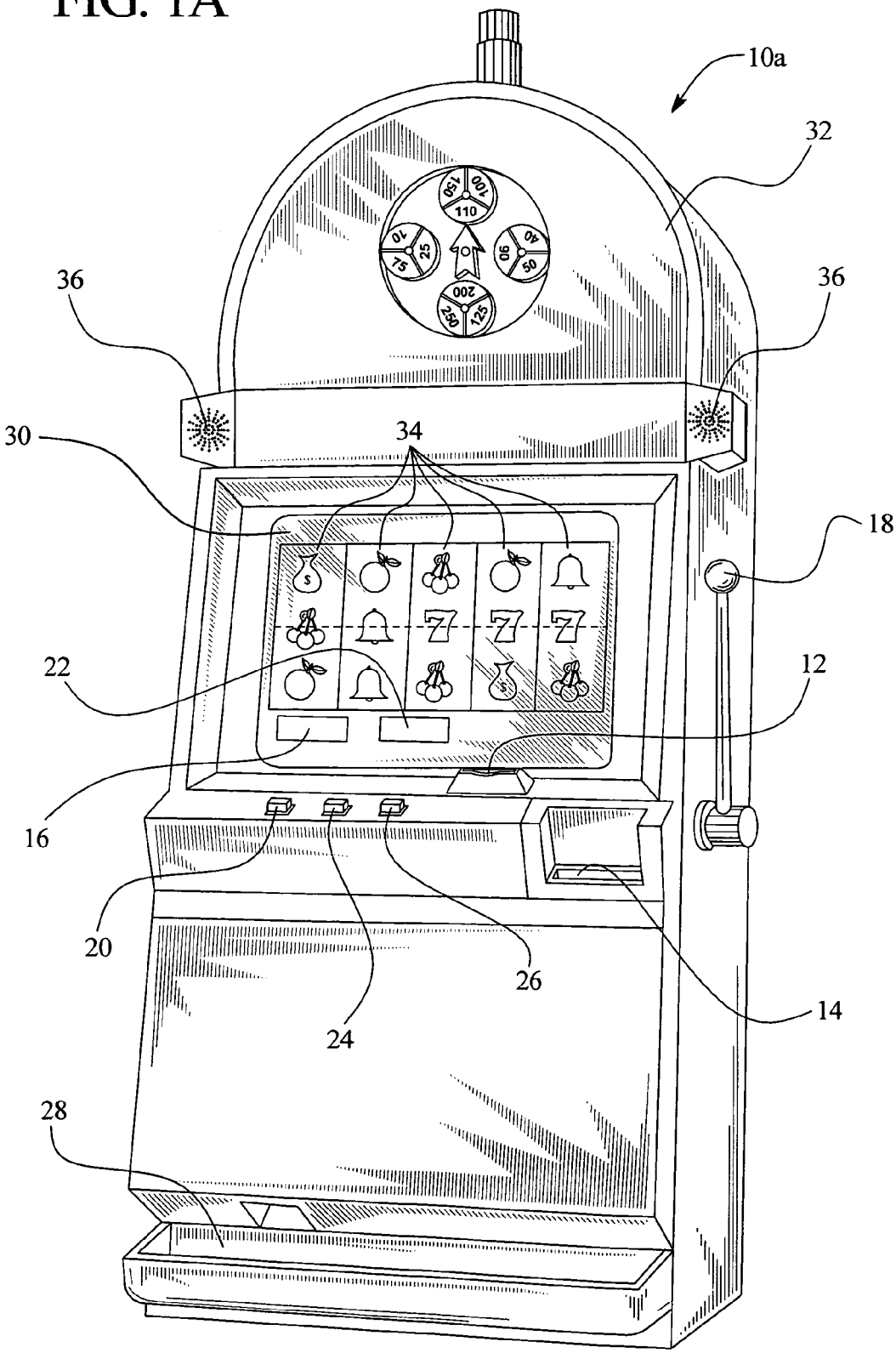
FIGS. 1A and 1B are perspective views of alternative embodiments of the gaming device of the present invention.
Figure 1B:
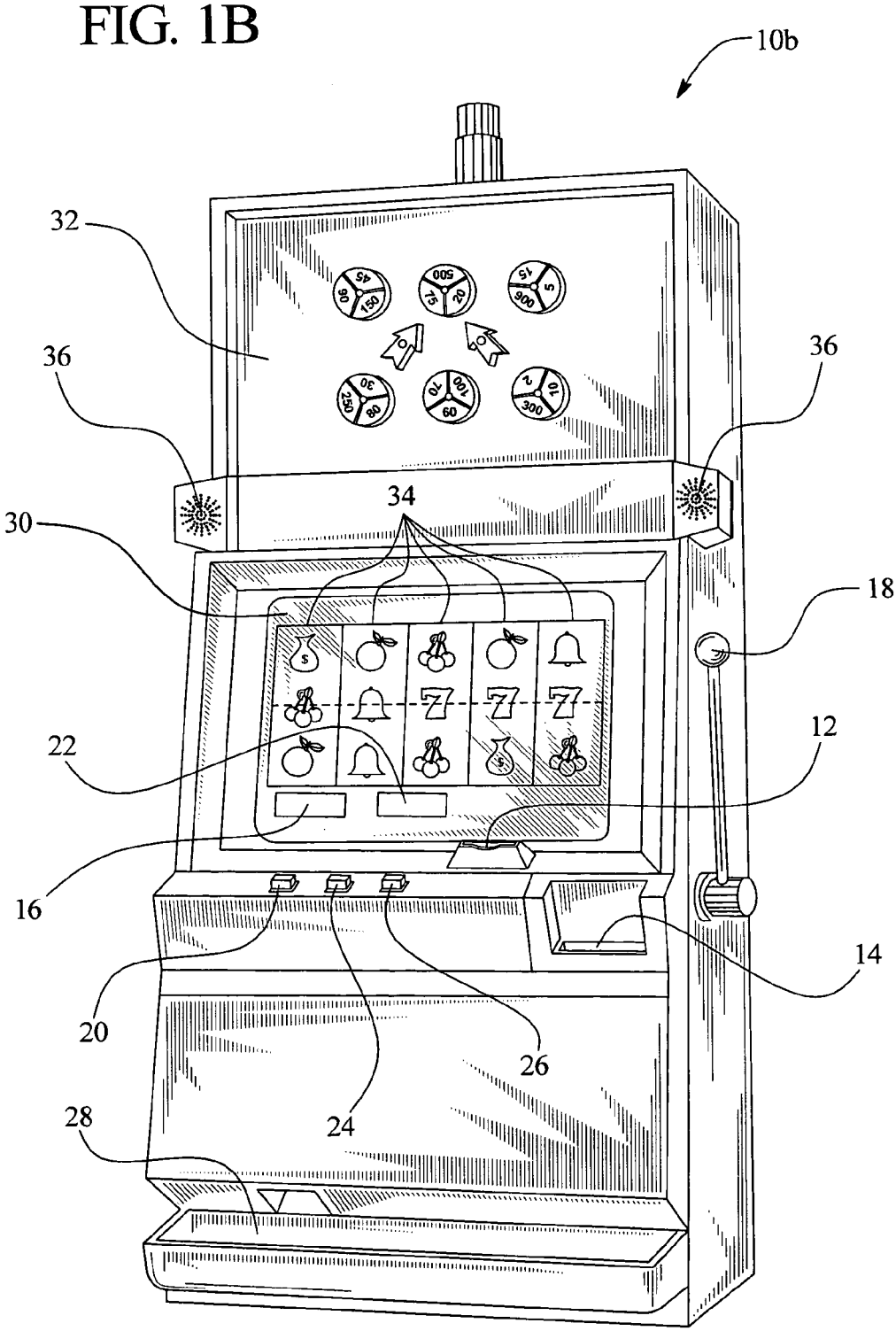

One primary embodiment for the display and display indicators is with a slot game. Referring now to the drawings, and in particular to FIGS. 1A and 1B, one slot machine embodiment is illustrated. Gaming devices 10*a* and 10*b* illustrate two possible cabinet styles and display arrangements and are collectively referred to herein as gaming device 10. Gaming device 10 is illustrated as having the controls, displays and features of a conventional slot machine, wherein the player operates the gaming device while standing or sitting. Gaming device 10 also includes being a pub-style or table-top game (not shown), which a player operates while sitting.

Gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. A player may cash out by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiments shown in FIGS. 1A and 1B include a display device 30 and a cabinet having an upper display area 32. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The display and display indication of the present invention is provided, in an embodiment, in the area of the upper display area the cabinets of gaming devices 10*a* and 10*b* of FIGS. 1A and 1B. The display and display indication of the present invention is provided, in another embodiment, on top of the rounded cabinet of gaming device 10*a* or rectangular cabinet of gaming device 10*b*. In a further embodiment, the top portion or top box of the gaming device is removed, creating a lower profile machine. Here, the display and display indication of the present invention sits on top of gaming device 10 but is lower to the ground than if the top box is not removed.

The slot machine embodiment of gaming device 10 includes a plurality of reels 34, for example three to five reels 34. Each reel 34 includes a plurality of indicia such as bells, hearts, fruits, numbers, letters, bars or other images which correspond to a theme associated with the gaming device 10. If the reels 34 are in video form, the display device displaying the video reels 34 is, in one embodiment, a video monitor. Gaming device 10 includes speakers 36 for making sounds or playing music.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. The gaming device 10 employs a video-based display device 30 for the bonus games. The bonus games include a program that automatically begins when the player achieves a qualifying condition in the base game.

Figure 2:
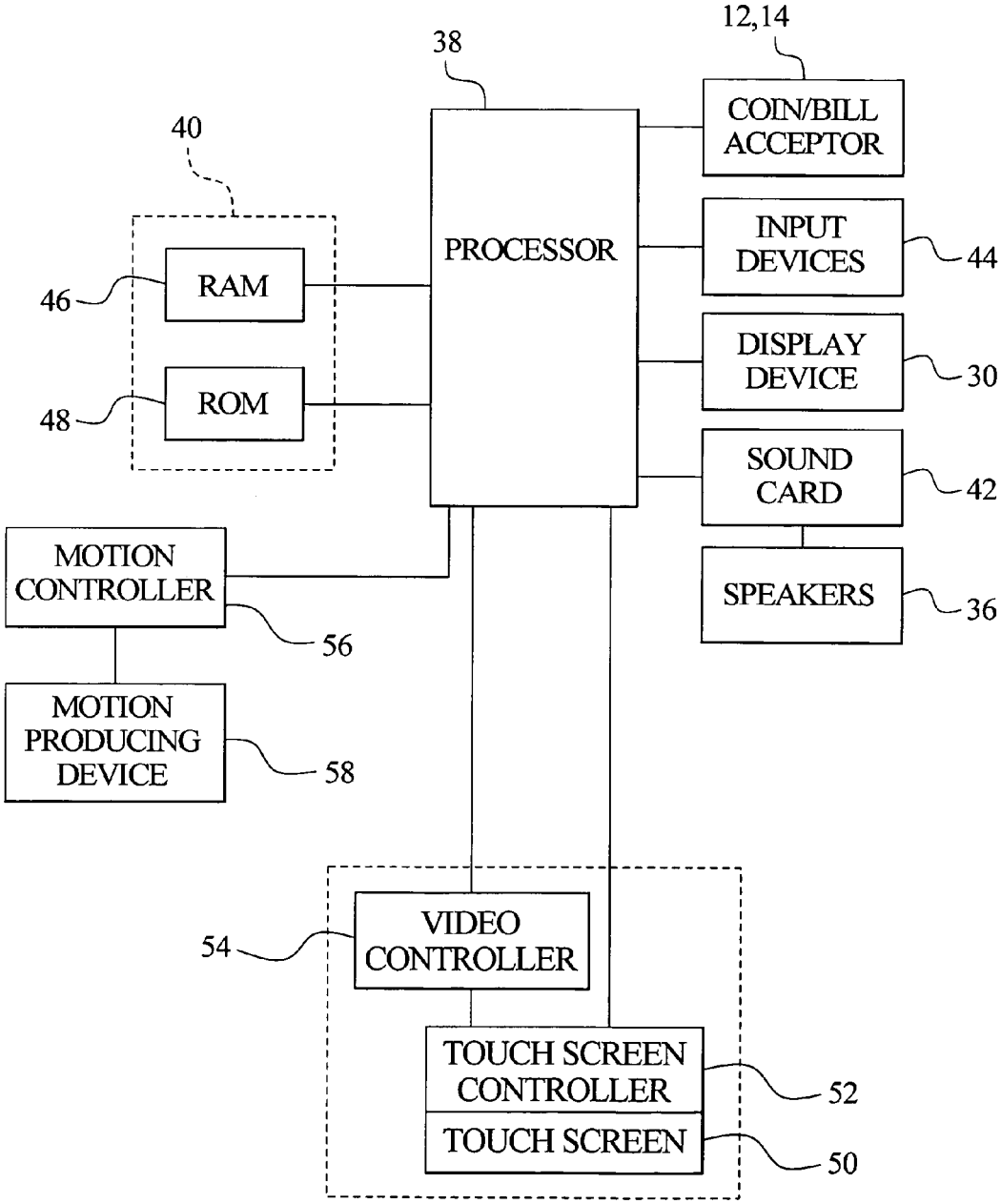
FIG. 2 is a schematic block diagram of the electronic configuration of one embodiment of the gaming device of the present invention.

Referring now to FIG. 2, one embodiment of an electronic configuration for gaming device 10 includes: a processor 38; a memory device 40 for storing program code or other data; a display device 30; a sound card 42; a plurality of speakers 36; and one or more input devices 44. The processor 38 is a microprocessor based platform that is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player uses the input devices 44 to input signals into gaming device 10. In the slot machine base game, the input devices 44 include the pull arm 18, play button 20, the bet one button 24, the cash out button 26 and other player inputs. A touch screen 50 and touch screen controller 52 are connected to a video controller 54 and processor 38. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money to start the game.

The processor 38 also controls the output of one of more motion controllers 56 that control one or more motion producing devices 58. The motion producing devices 58 can be any combination of motors, stepper motors, linear stepper motors or other types of linear actuators. The motion controllers 56 typically include printed circuit boards or stand alone enclosures that receive high level commands from the processor 38. The motion controller 56 converts the high level commands, for example, into a number of step pulses, which in turn are converted into motor currents. The stepper motor or other type of motion producing device 58 receives the currents, wherein the currents cause, for example, a rotor to turn within a stator a precise and desired amount.

As described more fully below, the rotational motion of a motor 58 can be used to rotate a member or indicator of the present invention. The rotational motion can alternatively be converted to cause a portion of the display to translate. Otherwise, a linear motion producing device 58 can be used to directly cause a portion of the display to translate.

The motion control scheme facilitates complex movements of multiple parts to be programmed into the memory device 40 and carried out by the processor 38 at the appropriate time in the sequence of the game, be it a base, bonus, bonus triggering or progressive sequence of gaming device 10. The motion sequences are alternatively stored in the motion controllers 56. Moreover, multiple programs can be implemented in the memory device 40, wherein the processor runs the appropriate program at the appropriate time, and wherein the members and indicators described below can perform or move differently, e.g., faster, slower or in different directions at different times, at different points in the game and in different sequences. The motion control programs, in an embodiment, interface with one or more random generation devices, typically software based items, to produce randomly displayed outcomes on the displays and indicators of the present invention. For example, the processor runs a random selection sequence to receive a result and then commands that a particular motion control program be run to achieve the result. The random result is therefore determined, in one embodiment, before or during the actual movement of the members and indicator(s).

Figure 3:
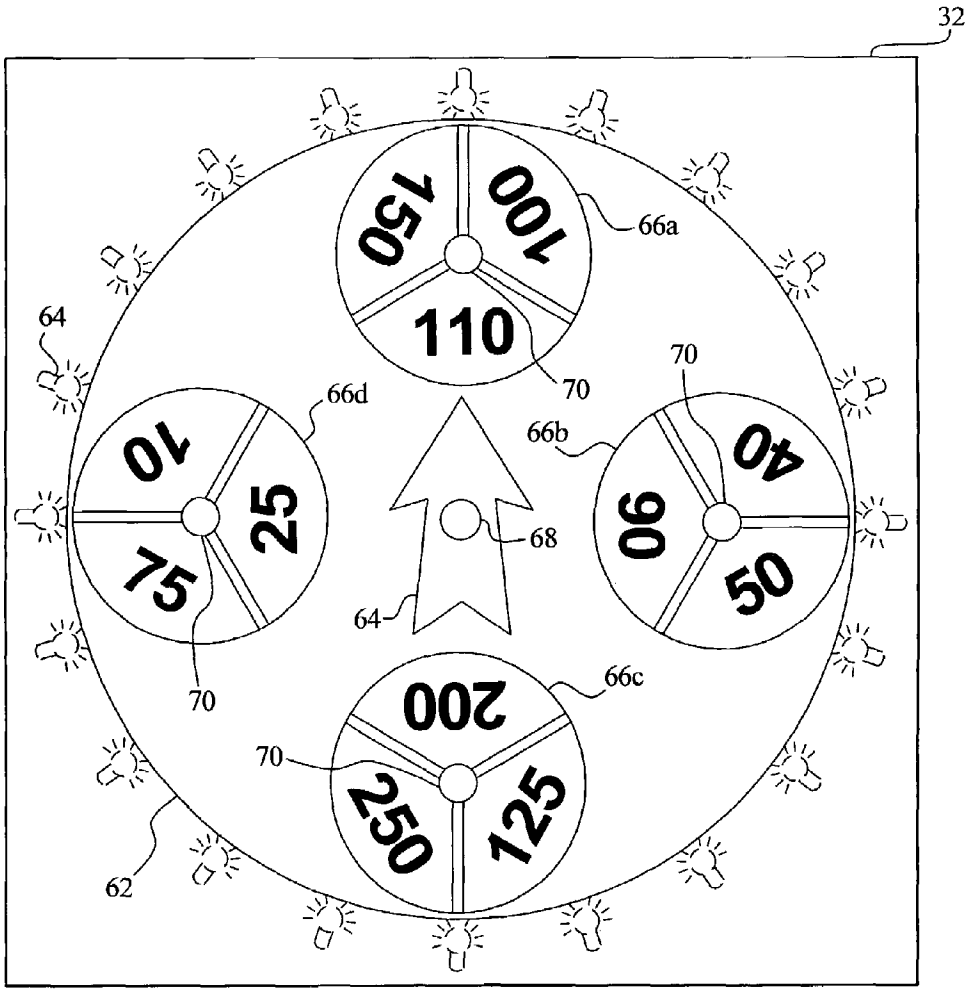
FIG. 3 is an elevation view of the upper display area illustrated in FIGS. 1A and 1B having one embodiment of the display with multiple rotating members.

Referring now to FIG. 3, a display 60 illustrates one embodiment of the gaming device display having the multiple rotating elements of the present invention. Display 60 is provided in one embodiment on the panel of the upper display area 32 illustrated in FIGS. 1A and 1B. Display 60 includes a circular border 62, however, the circular border 62 is not necessary for the functioning of the multiple elements of display 60. Display 60 also includes a number of lights 64 that illuminate display 60 from the front or provide backlighting from behind the panel of the upper display area 32. Display 60 also includes in one embodiment a number of reflective surfaces that reflect light in a desired manner.

As illustrated, border 62 surrounds the rotating elements of display 60. The rotating elements include a rotating indicator 64 and a plurality of rotating members 66*a* to 66*d*. Rotating indicator 64 rotates about pivot point 68. Rotating members 66*a* to 66*d* rotate about respective pivot points 70. The rotating indicator 64 is illustrated as having the shape of an arrow, however, the indicator can have any suitable shape desired by the game implementor that is capable of pointing to or indicating one of the rotating members 66*a* to 66*d*. The rotating members are illustrated as having circular shapes, however, the rotating members can alternatively have any suitable desired shape.

The members 66*a* to 66*d* and indicator 64 are shown as being rotating members, however, the members and indicator can have any type of motion, such as translational motion, rotational motion, or any combination thereof. Further, the pivot point 68 of the rotating indicator 64 is illustrated as being located within the indicator 64, however, pivot point 68 can alternatively be located behind the indicator at some radial distance desired by the game implementor.

The members 66*a* to 66*d* each display a plurality of symbols. The symbols represent any one of a number of different types of awards presentable to a player. The symbols in an embodiment represent gaming device credits. In other embodiments, the symbols represent a multiplier of gaming device credits, a number of free spins, a number of picks from a prize pool, a number of free games, an advancement into a secondary or bonus game and any combination of these.

In operation, the members 66*a* to 66*d* move so as to show the player that a random generation is taking place, wherein the symbols are sequentially and alternatingly displayed closer to the indicator 64 then any of the other symbols of the respective members 66*a* to 66*d*, such position being referred to herein as an indicating position. In FIG. 3, the symbol one hundred ten of member 66*a*, the symbol ninety of member 66*b*, the symbol two hundred of member 66*c* and the symbol twenty-five of member 66*d* are currently in indicating positions with respect to the other symbols of the respective members because these symbols are closer to the indicator 64 than are any other symbols of the respective members. The members rotate about pivot point 70 so that the symbols at various times will each be in the indicating position.

The members 66*a* to 66*d* and indicator 64 can have any desired relative motion. Members 66*a* to 66*d* can move or rotate in an overlapping fashion, simultaneously, alternatingly and sequentially and in any combination thereof with respect to one another and with respect to one or more indicators 64. For example, the members 66*a* to 66*d* can being to spin, whereafter rotating indicator 64 begins to spin, whereafter the members one by one stop to display an indicated symbol, and wherein the indicator 64 comes to a final resting position, selecting one of the indicated symbols. The selected symbol is then provided to the player as at least part of an award in accordance with the type of the symbol.

Rotating members 66*a* to 66*d* each have three symbols, however, the members can have any number of symbols suitably indicated by indicator 64 and may have different numbers of symbols. Lights 64 can also light sequentially, for example, follow the indicator 64 as it rotates about pivot point 68.

Figure 4:
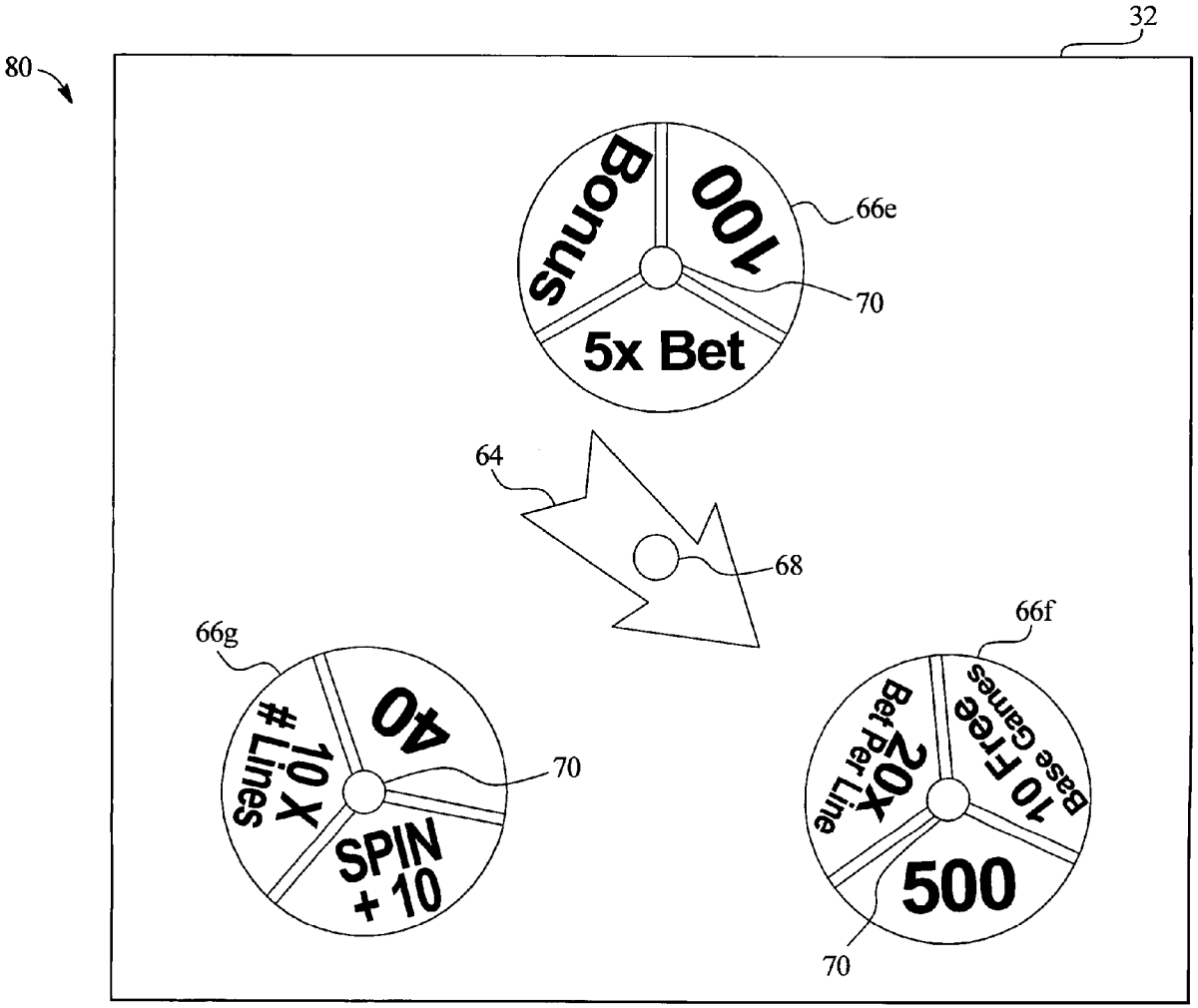
FIG. 4 is an elevation view of the upper display area illustrated in FIGS. 1A and 1B having an alternative embodiment of a display with multiple rotating members.

Referring now to FIG. 4, an alternative display 80 is illustrated. Display 80, like display 70, is provided on the panel of the upper display area 32. In any of the embodiments described herein, however, the displays can be provided in any suitable location on gaming device 10, such as on top of the gaming device, on the side of same or on the belly of the gaming device. Display 80 includes the indicator 64 that rotates about pivot point 68 as described above. Display 80 also includes three alternative rotating members 66*e* to 66*g*.

Display 80 illustrates that the present invention is not limited to providing rotating members as illustrated in FIG. 3, wherein the display 80 includes three indicators 66*e* to 66*g*. Each of the indicators also illustrates the various different types of awards or values of the present invention. Member 66*e*, for example, illustrates that the player may win an advancement to a bonus game, win five times the player's bets or win one hundred credits. Member 66*f* illustrates that the player may win ten free base games, five hundred credits or twenty times the amount wagered, for example, on a slot machine payline. Rotating or moving member 66*g* illustrates that the player may win 40 credits, a free spin plus ten credits or ten times the number of paylines wagered on a slot machine, for example.

Figure 5:
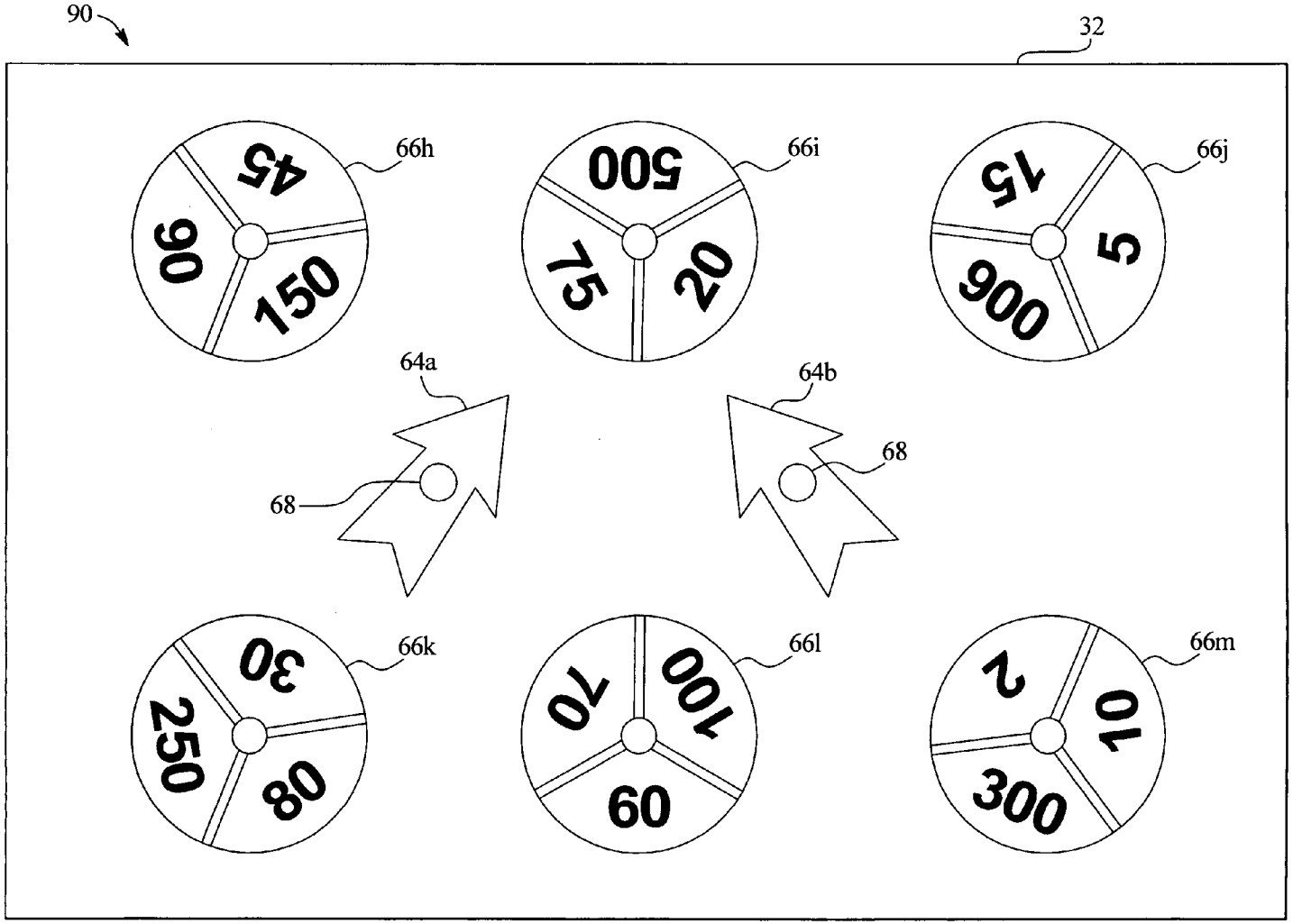
FIG. 5 is an elevation view of the upper display area illustrated in FIGS. 1A and 1B having a further alternative display with multiple rotating members and indicators.

Referring now to FIG. 5, a further alternative display 90 is illustrated. Display 90 includes six rotating members 66*h* to 66*m* and a plurality of rotating indicators 64*a* and 64*b*. Gaming device 10 is structured such that at the end of a sequence, one of the symbols is pointing towards a respective indicator and the indicator is pointing towards a selected one of the symbols from one of the rotating members. That is, based on the number of symbols provided per member, the member is rotated to a certain angle or range of angles in order to project one of the symbols towards the indicator, should the indicator point ultimately towards that member.

The illustrated examples have each provided three symbols per member, resulting in three equal wedge shapes, each shape spanning one hundred and twenty degrees. If, for example, four symbols are provided per member, the wedge-shaped sections would span ninety degrees, and the gaming device 10 would be modified so that there are four stopping positions instead of three. The total number of symbols per member dictates how many stopping positions there must be. The wedges on any particular member do not have to span the same range of degrees.

Display 90 is configured so that members 66*i* and 66*l* have stopping positions that each align with both the indicators 64*a* and 64*b*. In the illustrated example, member 66*i* displays the symbol of seventy-five that has stopped and is in line with indicator 64*a* and a symbol twenty that has stopped and is in line with, i.e., able to be indicated by indicator 64*b*. Thus in FIG. 5, two symbols from indicator 66*i* are currently selected by indicators 64*a* and 64*b*, which each rotate about a separate pivot point 68.

In display 90, the player can be provided with both symbols, wherein any desired mathematical operation may take place between the symbols, such as addition or multiplication. Alternatively, gaming device 10 can randomly generate one of the symbols selected by indicators 64*a* and 64*b*. Further alternatively, gaming device 10 can provide the higher of or lower of the symbols selected by indicators 64*a* and 64*b*. Display 90 includes any desirable and suitable sequence of motion between the plurality of movable or rotatable members 66*h* to 66*k* and movable or rotating indicators 64*a* and 64*b*. In an embodiment, each of the members stops before the indicators stop moving, wherein the indicators can stop moving at the same or at different times.

Figure 6:
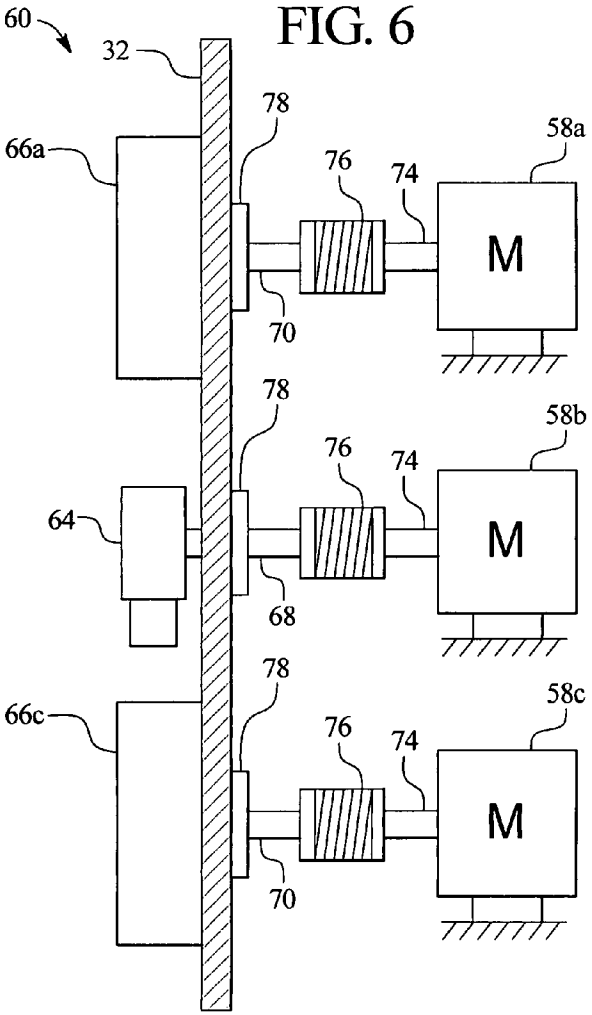
FIG. 6 is a sectioned side elevation view of the upper display area illustrated in FIGS. 1A and 1B showing one apparatus for rotating the multiple rotating members and indicator(s) of the present invention.

Referring now to FIG. 6, a section of the upper display area 32 having the display 60 of FIG. 3 is illustrated to show one embodiment for providing the rotational movement of the rotating members 66*a* and 66*c* and the rotational movement of the indicator 64. FIG. 6 illustrates a sectioned side view that shows the members 66*a* and 66*c* and indicator 64 on the outside of the machine and the inner workings of the motion control inside of the upper display area 32 of gaming device 10.

The pivot points 68 and 70 or the indicator 64 and members 66*a* to 66*c*, respectively, are defined by shafts that couple to a shaft 74 via a respective motor coupler 76. The motor coupler can be of a type that has a spring-like section, which allows for slight misalignment between the shaft 74 and pivot point 68 or 70. The pivot points or shafts 68 and 70 and the respective rotating members 66*a* and 66*c* and the rotating indicator 64 are held in place in an embodiment via bearings 78 as well as any other suitable mounting devices known to those of skill in the art.

Shafts 74 extend from motion producing devices 58*a* to 58*c* as illustrated. Motion producing devices 58*a* to 58*c* mount to a fixed, e.g., structural area, within gaming device 10. Motion producing devices 58*a* to 58*c* are in one embodiment stepper motors that are individually programmable via the processor 38 and one or more motion controllers 56 to store a plurality of different movement sequences in software (either in memory device 40 or in the controllers 56). The processor 38 calls up and implements one of the software sequences to set the display 60 in motion.

The individual stepper motors or other type of motion producing devices 58*a* to 58*c* enable complete, independent control of the rotating members 66*a* to 66*d* of FIG. 3 as well as the rotating indicator 64. This enables any of the members or indicator to rotate in any suitable direction (including in one direction and then in another direction), at any acceleration, at any velocity achievable by the horsepower of the stepper mower, wherein any of the members or indicator can start, stop, change direction, slow down, speed up at any level or rate for any amount of time desired by the game implementor.

The separate motion producing devices 58*a* to 58*c* provide the game implementor with full control over which, when, and how any of the devices move or rotate. If the members and/or indicator(s) alternatively translate rather than rotate, the rotation of the shaft 74 of the respective motion producing device 58 can be converted to a linear motion. Alternatively, a linear actuator can be provided as opposed to a rotating motor.

Figure 7A:
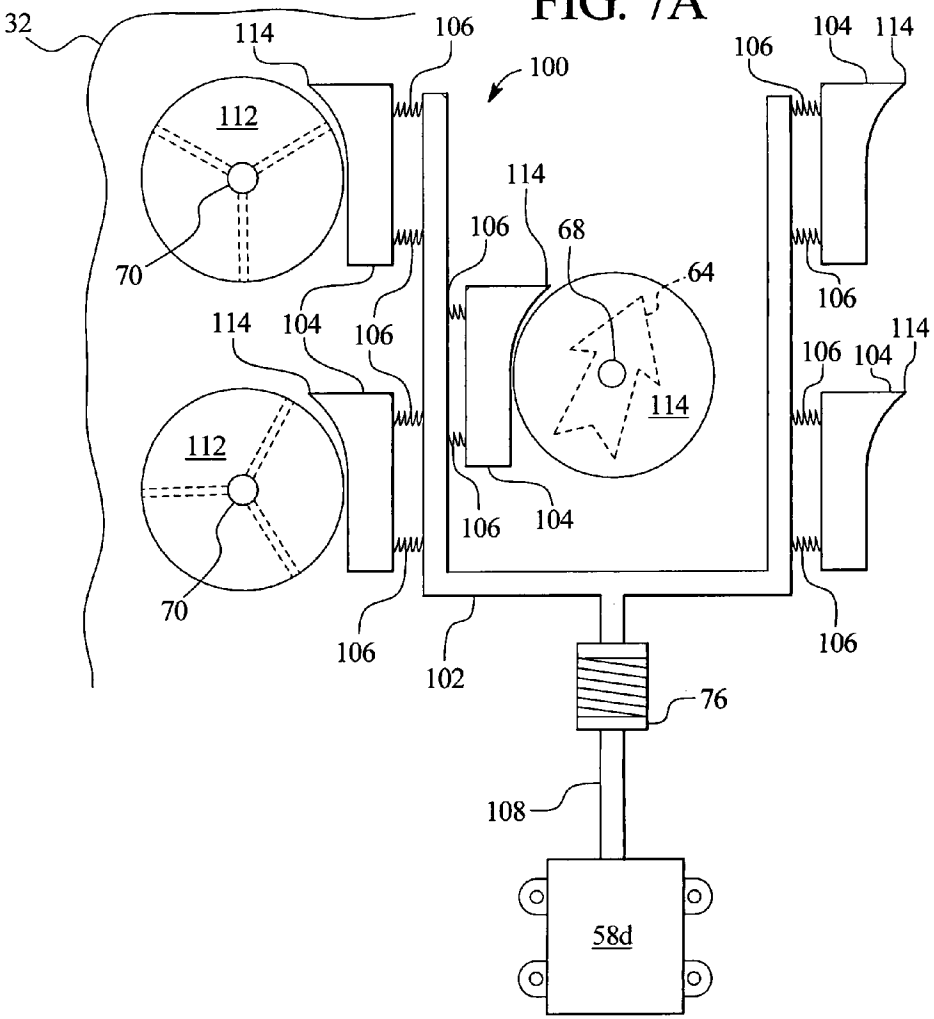
FIG. 7A is an interior view of the upper display area illustrated in FIGS. 1A and 1B showing another embodiment of an apparatus for rotating the multiple members and indicator(s) of the present invention.
Figure 7B:
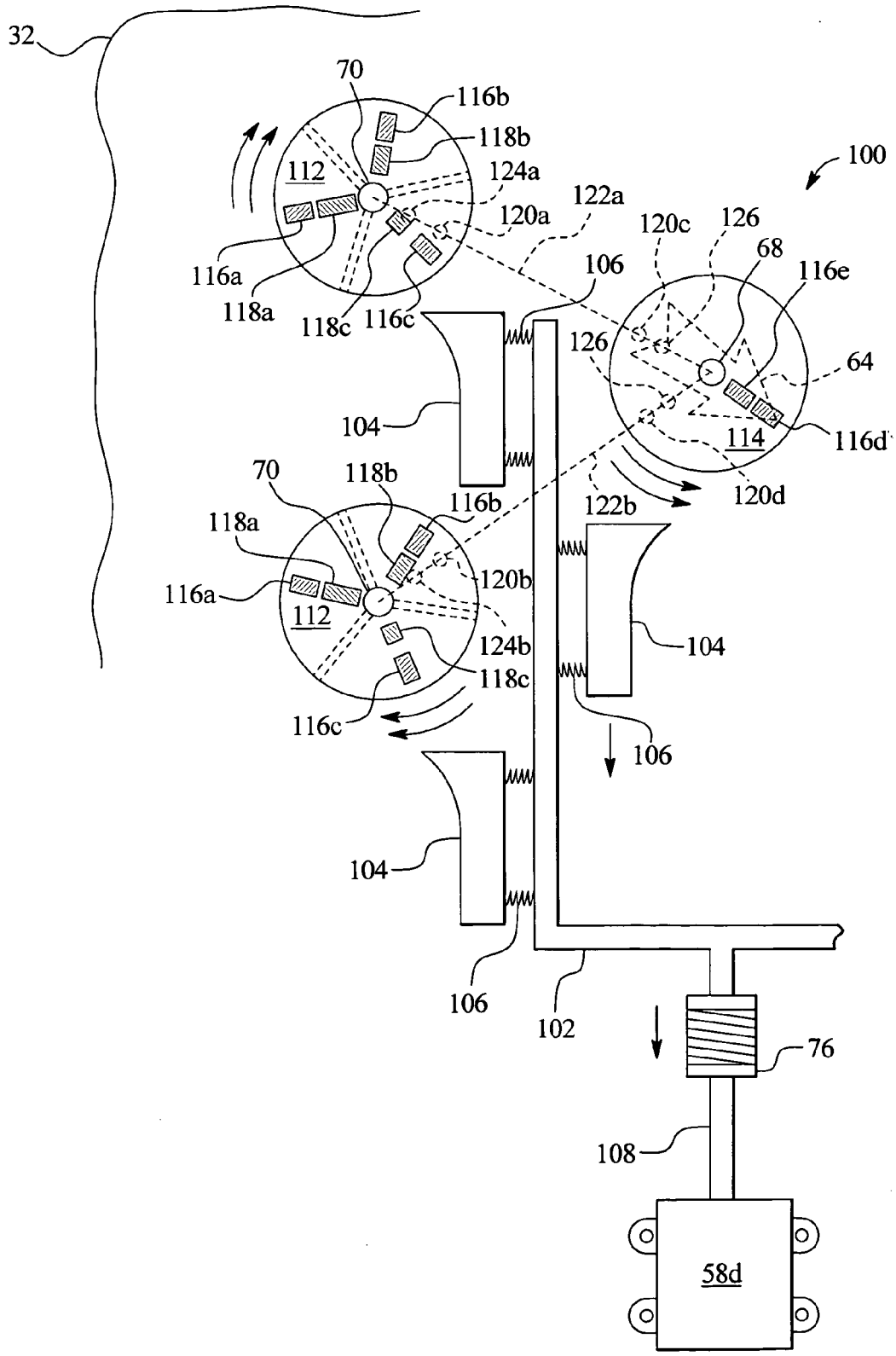
FIG. 7B illustrates the apparatus of FIG. 7A after the apparatus has been actuated and wherein the multiple members and indicator(s) are rotating.

Referring now to FIGS. 7A and 7B, one embodiment of a mechanical or electromechanical linkage 100 is illustrated. Linkage 100 illustrates one of a myriad of ways in which the display of the present invention can be mechanically or electromechanically implemented, wherein a single motion producing device 58*d*, in the illustrated embodiment, drives each of or alternatively a plurality of the members and/or indicator 64. Linkage 100 includes a "Y" shaped link 102 and a plurality of bumpers 104 connected to the link 102 via springs 106. A separate bumper 104 is provided for each rotating member and each rotating indicator 64. The pivot points 70 of the rotating members and the pivot point 68 of the rotating indicator 64 are illustrated for reference, however, the view of FIGS. 7A and 7B is from the inside of upper display area 32 of gaming device 10, so that the pivot points may not be seen in actuality.

The link 102 couples to the shaft 108 of a linear actuator 58*d* via coupler 76 having offset compensation. The members such as members 66*a* to 66*d* of display 60, couple on the inside of upper display area 32 with a respective rotating disk 112. The indicator 64 (shown in phantom for purposes of illustration) couples with a rotating disk 114. The rotating disks 112 and 114 have a mass designed to create a certain inertia when the link 102 and bumpers 104 impart a tangential force to the disks 112 and 114. The disks 112 and 114 are therefore weighted to spin at a desired speed and for a desired amount of time based on a designated speed of the linear actuation and on other mechanical factors, such as friction in bearings, lubrication, etc.

Springs 106 have a spring constant selected to enable the bumpers 104 to compress and lock into a loading position illustrated in FIG. 7A. The springs 106 are biased to push the bumpers 104 against the disks 112 and 114, so as to maintain a relatively stiff contact between the link 102 and the disks. The motion created by linkage 100 is simultaneous, that is, the rotating members and the rotating indicator 64 begin to spin at approximately the same time. The bumpers 104 in an embodiment can be provided with a slight lift 114 that further enables the bumpers to catch and pull the disks 112 and 114 as the linear actuator 58*d* pulls the link 102 downward in the illustrated FIGS. 7A and 7B. Lift 114 is sized and is alternatively compressible so that the bumpers 104 can be reloaded after the display performs its sequence and the linear actuator 58*d* pushes the link 102 up towards the disks 112 and 114.

FIG. 7B illustrates that linear actuator 58*d* has pulled actuator shaft 108 inward and correspondingly pulled link 102 downward, wherein bumpers 104 and springs 106 have imparted a tangential force on disks 112 (referring collectively to indicators 112*a* and 112*b*) and 114, causing the respective members and indicator 64 on the outside of the upper display area 32 to spin. Not only do the disks 112 and 114 begin to spin at the same time, they also have a fixed direction of rotation. The disks 112 and 114, however, can be weighted differently so that different disks stop rotating at different times given the same approximate tangential force via the translated link 102.

The software controlled motion of FIG. 6 enables the gaming device to randomly determine the player's symbol or award at any time before or even during the motion of the members and indicator. The motion of the shaft 74 of the motion-producing stepper motors 58*a* to 58*c* can therefore be a previously decided, randomly determined outcome performed as if the symbol is being randomly generated in real time. Gaming device 10 in the computer controlled embodiments knows which symbol or symbols to provide the player, that is, which symbol or symbols have been randomly generated, wherein the randomly generated symbol(s) is ultimately selected by the indicator 64.

The mechanical linkage 100 of FIGS. 7A and 7B, on the other hand, randomly determines the player's outcome or symbol in real time. Gaming device 10 has no way of knowing before the disks 112 and 114 are set in motion which symbol will ultimately be provided to the player. Gaming device 10 must therefore have some way of detecting which symbol of the members is in the indicating position, and which rotating member the indicator 64 winds up indicating. FIG. 7B illustrates one possible way of determining the symbol that is ultimately selected by the display.

The spinning disks 112*a* and 112*b* are each provided with magnetized metal inserts 116*a* to 116*c*. For example, the metal inserts 116*a* to 116*c* can be steel. Magnets 120*a* and 120*b* are provided at the indicating positions at the same or substantially the same radial location as the inserts 116*a* to 116*c*. The indicating position is that position which is located along lines 122*a* and 122*b* and the radial location of the inserts, closest to arrow 64, shown in FIG. 7B by the position of magnet 120*a* of spinning disks 112*a* and by magnet 120*b* of spinning disk 112*b*. The magnets for example can be imbedded in or attached to the panel of display area 32 behind the spinning disks 112*a* and 112*b* as shown in FIG. 7B. When the disks 112*a* and 112*b* ultimately come to a stop, the magnets seize one of the magnetized inserts 116*a* to 116*c* to lock or hold the inserts in the indicating position.

In addition to magnets 120*a* and 120*b*, light emitters and receivers of sensors 124*a* and 124*b* are provided, for example in the panel of area 32 or positioned towards the interior of gaming device 10 with respect to the disks 112. Differently sized reflective patches 118*a* to 118*c* are placed adjacent to inserts 116*a* to 116*c*. The light sensors are located in line with reflective patches 118*a* to 118*c* and send and receive different signals based on the amount of light that is reflected back from the differently sized reflectors 118*a* to 118*c*. The output is indicative of one of the symbols on the rotating member. The processor 38 receives the signal from the photosensors and thereby knows which of the symbols of the members have stopped in the respective indicating positions.

The central spinning disk 114 corresponding to the indicator 64 includes a metal insert 116*d* that represents the head of the indicator or arrow 64. Magnets 120*c* and 120*d* are placed (for example, in the panel of area 32) along each of the stopping position lines 122*a* and 122*b*. The stopping positions are located on lines 122*a* and 122*b* extending from pivot point 68 of indicator 64 to pivot points 70 of spinning disks 112. The magnets 120*c* and 120*d* are on a same radial distance from pivot point 68 as is the metal insert 116*d*. One of the magnets ultimately causes the disk 114 and indicator 64 to stop rotating and hold the insert 116*d* in alignment with one of the indicating positions. Sensors, such as proximity sensors 126 are placed along a plane defined by lines 122*a* and 122*b* in the panel of area 32 or inside gaming device 10 to detect a metal insert 128 located next to insert 116*d* at the tip or head of arrow 64. The appropriate proximity sensor sends a signal to processor 38 indicating that the disk 114 and indicator 64 have stopped at a particular position.

Using a superposition of sensor inputs from the light emitting/reflective sensors 124 (collectively referring to 124*a* and 124*b*) and proximity sensors 126, processor 38 of gaming device 10 determines, after each of the members 112 and indicator 64 stop moving, which symbol has been generated randomly for the player. It should be appreciated that FIGS. 7A and 7B provide merely one example of how gaming device 10 can determine, after a random generation occurs, which symbol of the rotating or moving members should be provided to the player.

Figure 8:
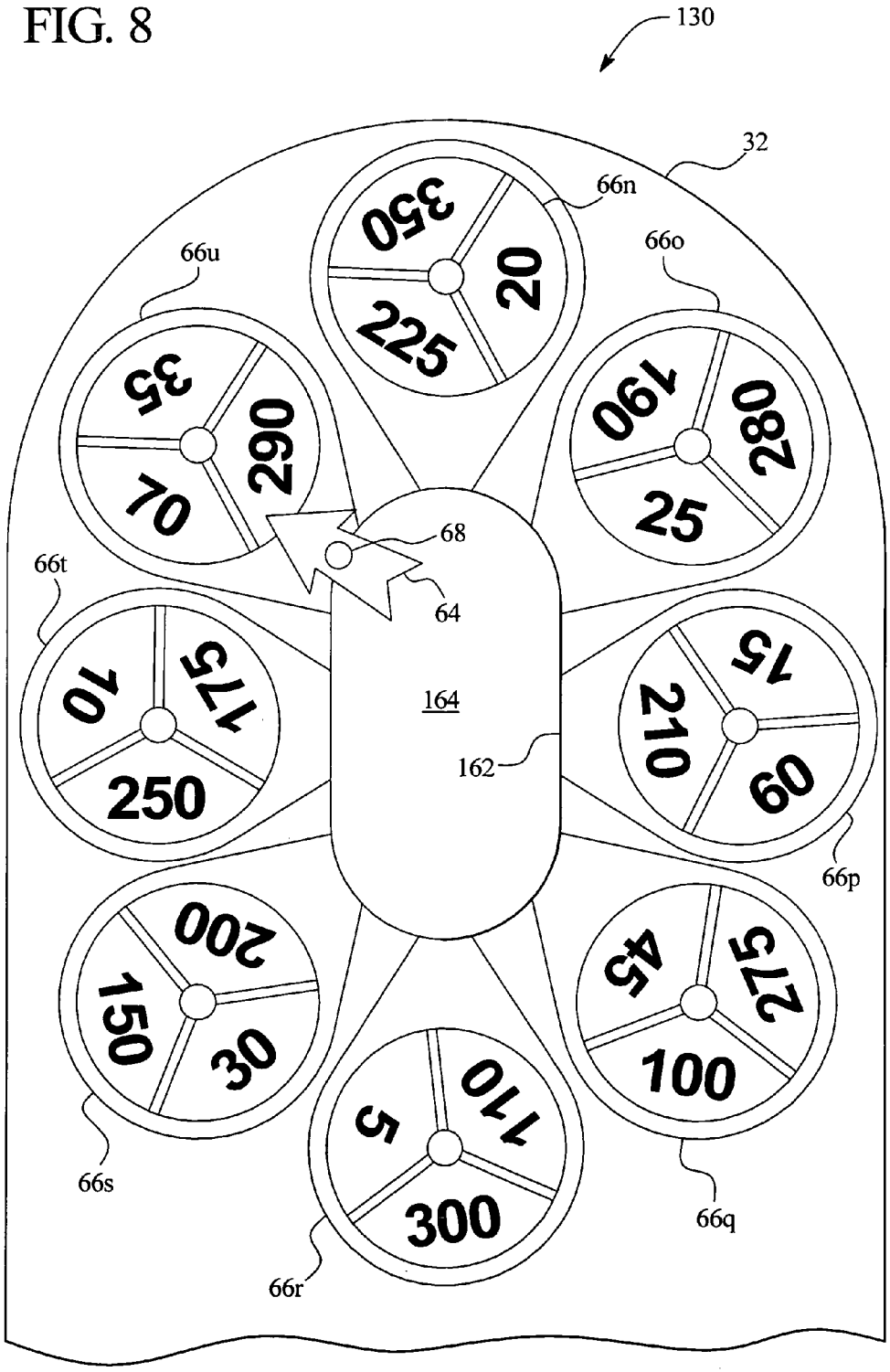
FIG. 8 is a front elevation view of the upper display area of the gaming device having another alternative display with an indicator that simultaneously spins and rotates.

Referring now to FIG. 8, another alternative display 130 is illustrated. Display 130 includes eight rotating members 66*n* to 66*u* and an indicator 64. Display 130 alternatively includes a different amount of rotating members. Gaming device 10 is structured such that at the end of a sequence, one of the symbols of the members is pointing towards a center point of panel portion 164, and wherein indicator 64 points towards that symbol. That is, based on a number of symbols provided per member, each member 66*n* to 66*u* is rotated so that when indicator 64 stops closest to one of the members, that member will be positioned so that one of its symbols is indicated by indicator 64.

In one embodiment, indicator 64 rotates or spins about pivot point 68 and stops spinning so that the indicator 64 points towards the symbol of the member 66*n* to 66*u* to which indicator 64 is closest in proximity. As illustrated, the upper display area 32 defines a continuous slot 162, which in turn defines the inner panel portion 164. Slot 162 is alternatively not continuous, wherein portion 164 is connected to the rest of the panel via one or more tabs, which would restrict the movement of indicator 64.

Indicator 64 spins about pivot point 68 via any of the profiles and embodiments described above for such motion. At a different time, at the same time or both, pivot point 68 rotates about an axis that is substantially at the center of inner panel portion 164, through the path defined by slot 162. Indicator 64 can spin in either or both directions, at any suitable one or more angular speeds and accelerations about pivot point 68. At the same time or at different times, indicator 64 can rotate in either or both directions, at any suitable one or more angular velocities and accelerations about a point substantially in the center of inner panel portion 164. Although the oval shape of portion 164 defined by slot 162 is preferred one embodiment, portion 164 and slot 162 can have different shapes, such as a circular shape or a non-symmetrical shape, such as an egg shape.

Figure 9:
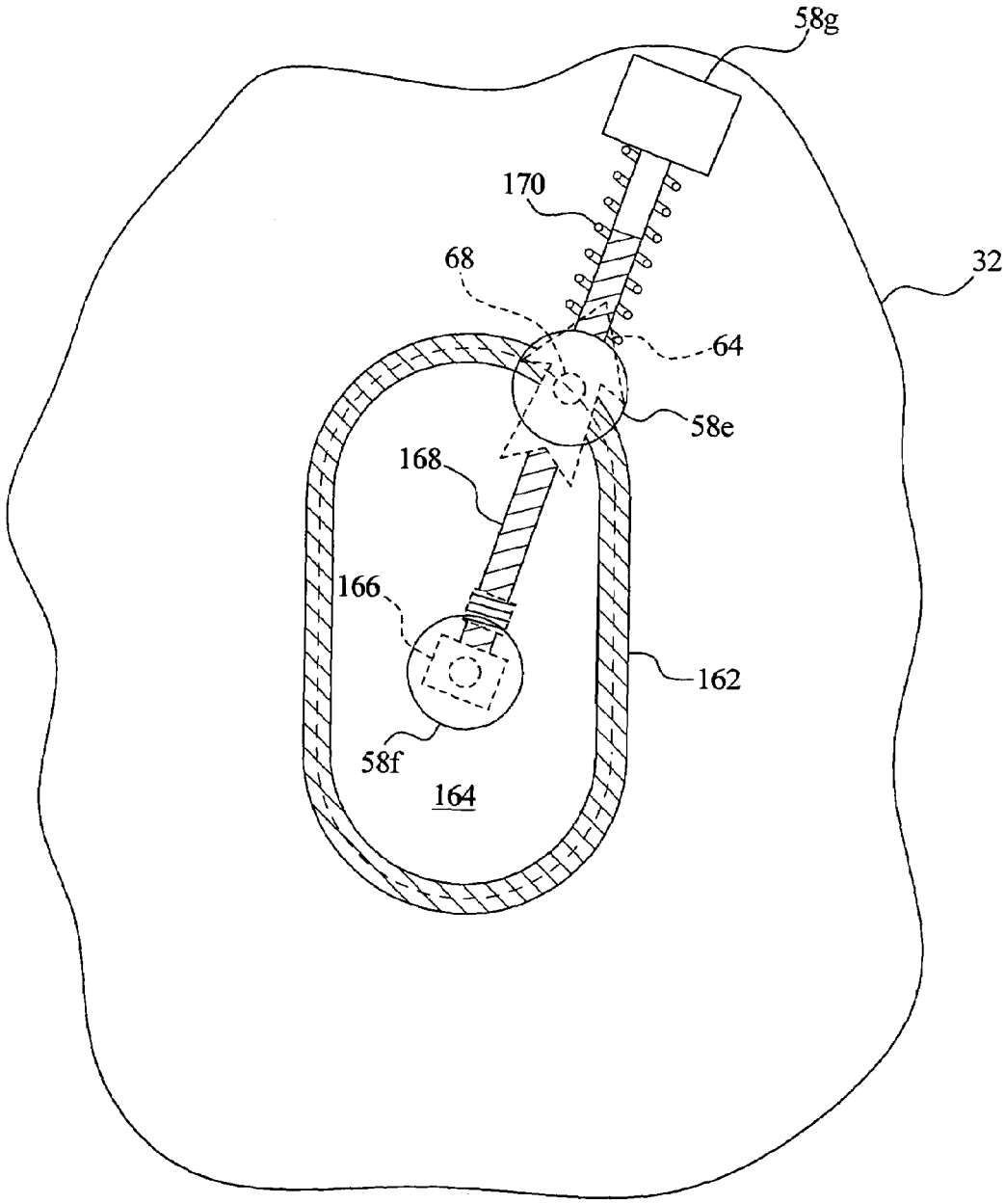
FIG. 9 is an interior view of the display of FIG. 8 showing a number of possible motor configurations to produce the motion discussed in FIG. 8.

Referring now to FIG. 9, various embodiments for configuring motion producing devices 58*e* to 58*g* are illustrated. Motion producing device 58*f* is mounted behind a bearing 166, which in turn resides behind center panel portion 164. Motion producing device 58*f* turns the entire assembly so that the pivot 68 moves through slot 162. Bearing 166 is coupled rotationally to and supports a shaft 168 along which motion producing device 58*e*, the pivot of pivot point 68 and indicator 64 move radially. In one embodiment, shaft 168 is a threaded shaft, which is rotated by a third motion producing device 58*g*. In one preferred embodiment one or more or all of the motion producing devices 58*e* to 58*g* are stepper motors as described herein.

Stepper motor 58*g* coordinates with stepper motor 58*f* to turn lead screw 168 so that indicator 64 is moved to a proper radial position based on the angular position of threaded shaft 168, which is determined by the motion of motion producing device 58*f*. Likewise, stepper motor 58*e* coordinates with motion producing device 58*f*, so that indicator 64 is turned at the end of the motion profile to point to the symbol of the member to which indicator 64 is closest in proximity.

In one alternative embodiment, motion producing device 58*g* is not used and instead a biasing mechanism or spring 170 is used and is biased to push the pivot of pivot point 68, so that the pivot rides in slot 162 as motion producing device 58*f* rotates the entire assembly. Suitable bearings, such as roller bearings or ball bearings may be placed either in the pivot of pivot point 68 or in the slot 162 defined by inner panel portion 164 and upper display area 32 to provide a smooth surface for the pivot of pivot point 68 to ride along as the spring 170 pushes the pivot of pivot point 68. In a further alternative embodiment, indicator 64 and the pivot of pivot point 68 are not biased and are merely left to be moved by the walls defining slot 162 as motion producing device 58*f* rotates the entire assembly.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device operated under control of at least one processor, said gaming device comprising:

a cabinet;

a game controlled by the processor and operable upon a wager by a player; and at least one display controlled by the processor and connected to the cabinet, the display including:

(i) a plurality of independently moveable members, each member having at least one symbol, and at least one of the members having a plurality of symbols, and (ii) a plurality of independently moveable indicators, each said moveable indicator configured such that said indicator is positionable to sequentially indicate each of a plurality of the members, said display operable to indicate an outcome based on at least one of the symbols on the members which are indicated by the indicators.

2. The gaming device of claim 1, wherein the symbols represent values and the outcome includes an award based on one of (a) one of the values represented by the symbols on said moveable members indicated by the indicators;

(b) a plurality of the values represented by the symbols on said members indicated by the indicators;

(c) a mathematical operation on a plurality of the values represented by the symbols on said members indicated by the indicators;

(d) a higher one of a plurality of the values represented by the symbols on said moveable members indicated by the indicators;

(e) a lower one of a plurality of the values represented by the symbols on said members indicated by the indicators; and (f) a randomly selected one of a plurality of the values represented by the symbols on said members indicated by the indicators.

3. The gaming device of claim 1, wherein (a) at least one of the members includes a rotatable wheel divided into sections, wherein each section includes one of the symbols;

(b) a plurality of the members each include a rotatable wheel divided into sections, wherein each section of each member includes one of the symbols; or (c) all of the members each include a rotatable wheel divided into sections, wherein each section of each member includes one of the symbols.

4. The gaming device of claim 1, wherein each of the plurality of members have a plurality of symbols.

5. The gaming device of claim 1, wherein at least one of said indicators is configured to not be positionable to indicate any of the symbols of one of the plurality of members.

6. The gaming device of claim 1, wherein a plurality of the indicators are each configured to be positionable to simultaneously indicate separate symbols of one of the plurality of the members.

7. The gaming device of claim 1, wherein at least one of the indicators is positioned between two of the members.

8. The gaming device of claim 1, wherein the display is part of the game.

9. The gaming device of claim 1, wherein at least one of the indicators is rotatable about an axis.

10. The gaming device of claim 1, wherein at least one of the members is rotatable about an axis.

11. The gaming device of claim 1, wherein each of the indicators and each of the members are have an axis of rotation and are each rotatable about their axis of rotation.

12. A method of operating a gaming device having a game operable upon a wager, said method comprising:

(a) initiating a game upon a wager by a player;

(b) provide a display including (i) a plurality of independently moveable members, each member having at least one symbol, and at least one of the members having a plurality of symbols, and (ii) a plurality of independently moveable indicators, each said moveable indicator configured such that said indicator is positionable to sequentially indicate a plurality of the members; and (c) causing at least one of the members and indicators to move to indicate an outcome based on at least one of the symbols on the members which are indicated by the indicators.

13. The method of claim 12, which includes causing one of (a) at least one of the members to move and at least one of the indicators to move to indicate the outcome;

(b) a plurality of the members to move to indicate the outcome;

(c) a plurality of the indicators to move to indicate the outcome;

(d) a plurality of the members to move and a plurality of the indicators to move to indicate the outcome; and (e) all of the members to move and all of the indicators to move to indicate the outcome.

14. The method of claim 12, wherein the symbols represent values and the outcome includes an award based on one of (a) one of the values represented by the symbols on said members indicated by the indicators;

(b) a plurality of the values represented by the symbols on said members indicated by the indicators;

(c) a mathematical operation on a plurality of the values represented by the symbols on said moveable members indicated by the indicators;

(d) a higher one of a plurality of the values represented by the symbols on said members indicated by the indicators;

(e) a lower one of a plurality of the values represented by the symbols on said members indicated by the indicators; and (f) a randomly selected one of a plurality of the values represented by the symbols on said members indicated by the indicators.

15. The method of claim 12, wherein (a) at least one of the members includes a rotatable wheel divided into sections, wherein each section includes one of the symbols;

(b) a plurality of the members each include a rotatable wheel divided into sections, wherein each section of each member includes one of the symbols; or (c) all of the members each include a rotatable wheel divided into sections, wherein each section of each member includes one of the symbols.

16. The method of claim 12, wherein each of the plurality of members have a plurality of symbols.

17. The method of claim 12, wherein at least one of said indicators is configured to not be positionable to indicate any of the symbols of one of the plurality of members.

18. The method of claim 12, wherein a plurality of the indicators are each configured to be positionable to simultaneously indicate separate symbols of one of the plurality of members.

19. The method of claim 12, wherein at least one of the indicators is positioned between two of members.

20. The method of claim 12, wherein the display is part of the game.

21. The method of claim 12, wherein at least one of the indicators is rotatable about an axis.

22. The method of claim 12, wherein at least one of the members is rotatable about an axis.

23. The method of claim 12, wherein each of the indicators and each of the members are have an axis of rotation and are each rotatable about their axis of rotation.

* * * * *